US007614104B2

(12) United States Patent
Wang et al.

(10) Patent No.: US 7,614,104 B2
(45) **Date of Patent: *Nov. 10, 2009**

(54) FLOATING WATER BED

(76) Inventors: Yi Jing Wang, 18428 Desidia St., #C, Rowland Heights, CA (US) 91748; Zhirong Wang, 18428 Desidia St., #C, Rowland Heights, CA (US) 91748

( * ) Notice: Subject to any disclaimer, the term of this patent is extended or adjusted under 35 U.S.C. 154(b) by 0 days.

This patent is subject to a terminal disclaimer.

(21) Appl. No.: 12/002,123

(22) Filed: Dec. 14, 2007

(65) Prior Publication Data

US 2008/0092301 A1 Apr. 24, 2008

Related U.S. Application Data

(63) Continuation-in-part of application No. 11/496,785, filed on Aug. 1, 2006, now Pat. No. 7,353,554.

(51) Int. Cl.
*A47C 27/08* (2006.01)

(52) U.S. Cl. ..... 5/665; 5/422; 5/669; 5/413 R

(58) Field of Classification Search ..... 5/422, 5/676–678, 687, 665, 413 R, 668, 669; 601/81, 601/85, 86; 607/81, 85, 86
See application file for complete search history.

(56) References Cited

U.S. PATENT DOCUMENTS 1,943,888 A * 1/1934 Ewald ..... 5/665
3,961,380 A * 6/1976 Garr ..... 4/534
4,000,749 A * 1/1977 Busco ..... 600/21
4,079,728 A * 3/1978 Gatts ..... 600/22
4,662,010 A * 5/1987 Silberling ..... 5/686
4,727,607 A * 3/1988 Nystad ..... 5/678
6,986,178 B2 * 1/2006 Turner ..... 5/413 R
7,353,554 B2 * 4/2008 Wang ..... 5/665

* cited by examiner

*Primary Examiner*—Michael Trettel
(74) *Attorney, Agent, or Firm*—Raymond Y. Chan; David and Raymond Patent Firm

(57) ABSTRACT

A floating water bed for a user being floatably surrounded with liquid, includes a sleeping bed, which is made of waterproof material, having a compartment for the user accommodating therein that the user is floating and supporting by the liquid, and a breathing opening communicating with the compartment and arranged in such a manner that when the user rests in the compartment, the breathing opening is aligned with a head of the user, wherein the breathing opening is adapted for air circulation of the compartment with ambient atmosphere, such that the sleeping bag is adapted for allowing the user to achieve absolute relaxation while achieving complete rest, wherein the sleeping bag is adapted for completely separating the user from the liquid surrounding and thus protecting the user within the sleeping bag.

20 Claims, 15 Drawing Sheets

FLOATING WATER BED

CROSS REFERENCE OF RELATED APPLICATION

This is a Continuous-In-Part application of a non-provisional application having an application Ser. No. of 11/496,785 and filing date of Aug. 1, 2006 now U.S. Pat. No.7,353,544.

BACKGROUND OF THE PRESENT INVENTION

1. Field of Invention

The present invention relates to a bed, and more particularly to a floating water bed which is capable of floatably supporting a human body in water.

2. Description of Related Arts

This new invention is called, the floating water bed. This new innovation is different from all previous known water beds. This new water bed is modeled after the idea that: when any solid object is placed in water, the water will exert a force on this solid object. When the specific gravity of the object is less than that of the water, the object will float on the water. When the specific gravity of the object is equal to or greater than that of the water, the object will float in mid-water or sink to the bottom. When the object is floating in mid-water, the pressure exerted by the water onto this object is evenly distributed throughout the surface of this object. This same idea can be applied to when a human body is placed in water. Since the specific gravity of a human is greater than that of water, the human being will like-wise float in mid-water or sink to the bottom. The amount of pressure exerted by the water onto the human being is evenly distributed throughout the surface of the human as well. At this time, the human being will experience a loosening and relaxing of all the various muscles within the body. The human being will not experience significant pressure in any one spot of his body since the pressure is evenly distributed throughout. This method can be used to reduce an individual's muscular fatigue, reduce stress, improve sleep, increase bodily strength and produce numerous other benefits.

SUMMARY OF THE PRESENT INVENTION

The floating water bed is therefore designed after this therapeutic method. Its specialty includes a specially designed unique sleeping bag and a movable mattress pad. The innovative sleeping bag is both thin and soft and it is placed on top of the movable mattress pad. This movable mattress pad can be lowered or risen from the water. As the human being rests within the sleeping bag, with the press of a button, the mattress pad can be lowered into the water along with the sleeping bag and the individual inside. At this time, the individual inside the sleeping bag will be floating in mid-water and will begin experiencing soothing relaxation. The floating water bed will have a well-shaped hole perpendicular to the sleeping bag and rising out of the water, providing the individual with an entrance into the sleeping bag as well as a breathing space once they are within the sleeping bag. With this well-shaped hole, the individual can breathe easily without the use of oxygen masks or additional equipment. This new floating water bed can then truly produce the effects of reducing stress, increasing bodily strength, improving sleep, and relieving muscular fatigue.

These and other objectives, features, and advantages of the present invention will become apparent from the following detailed description, the accompanying drawings, and the appended claims.

DETAILED DESCRIPTION OF THE PREFERRED EMBODIMENT

As mentioned above, the Floating Water Bed, is a completely new and never before seen product.

Figure 1:
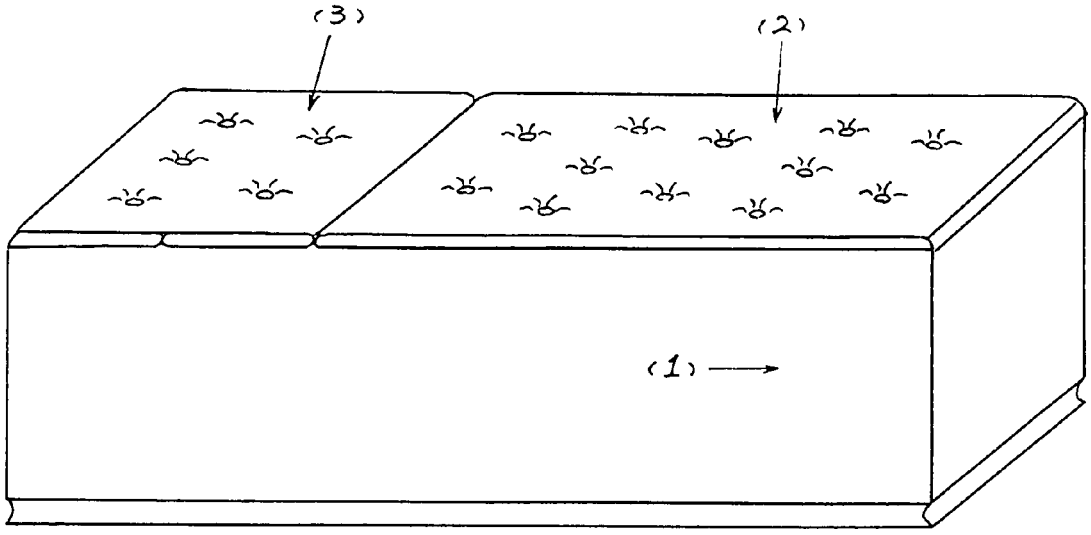
FIG. 1 is a perspective view of a floating water bed according to a first preferred embodiment of the present invention.
Figure 2:
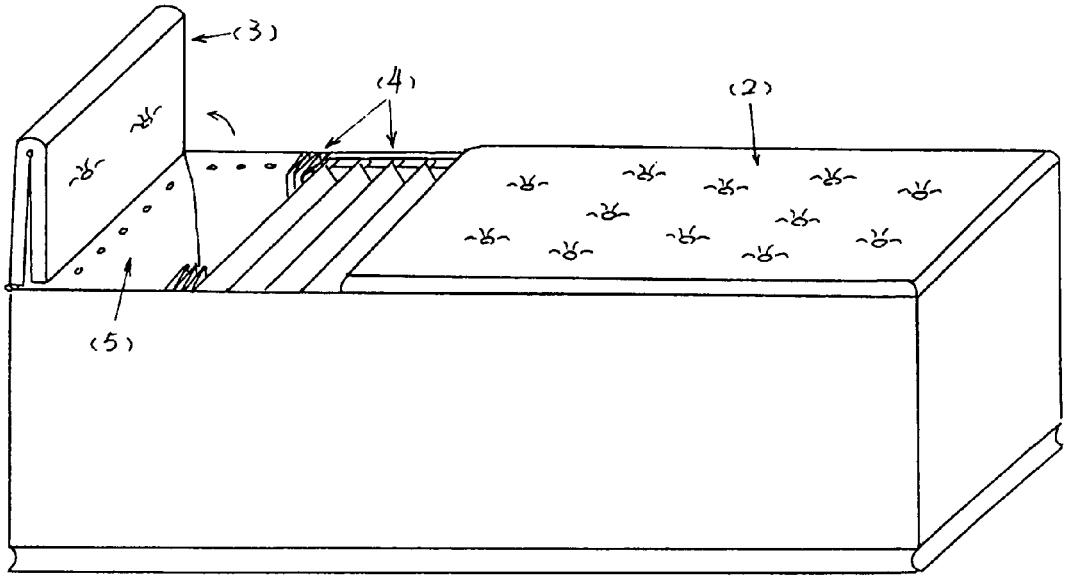
FIG. 2 is a perspective view of the floating water bed with the bed surface halfly opened according to the above first preferred embodiment of this invention.

First, this new product is produced for the purpose of allowing human beings to rest and relax. Therefore, the outer appearance of this product is similar to the outer appearance of traditional bed mattresses. The difference is the Floating Water Bed is sealed all around while the traditional mattress is hollow. Please see drawings FIG. 1 and FIG. 2 for the following descriptions:

Numbers (2) and (3) illustrate the surface of the Floating Water Bed. The inner layer of the surface (2) (3) can be made from sponge-like or other soft material to produce a cushioning for the surface (2) (3). The outer layer of the surface (2) (3) can be produced by using leather or other similar material and wrapping it around the inner sponge-like material. Then use round pins on the surface (2) (3) of the Floating Water Bed to secure the leather to the inner sponge layer. This will produce a bed surface that is both three dimensional and pleasing to the eye. The pins will also prevent the sponge cushioning from moving underneath the leather wrapping. In the drawing, surface (3) can be retracted and folded for the purpose that when it is closed, it together with surface (2) in the drawing can produce a whole bed surface. An individual can choose to rest on this surface (2) (3) as he would on a regular bed mattress. When surface (3) is opened but folded, it can become a back rest for the individual as he climbs into a sleeping bag (6) that has just been lifted from the water and towards the surface (2) (3). Number (5) in the drawing illustrates a well-shaped hole that can provide for entrance into the sleeping bag (6) as well as a breathing hole for the individual inside the sleeping bag (6). Number (1) in the drawing illustrates the surrounding walls of the bed structure. These walls (1) can be made by using wood or other similar hard materials.

Figure 3:
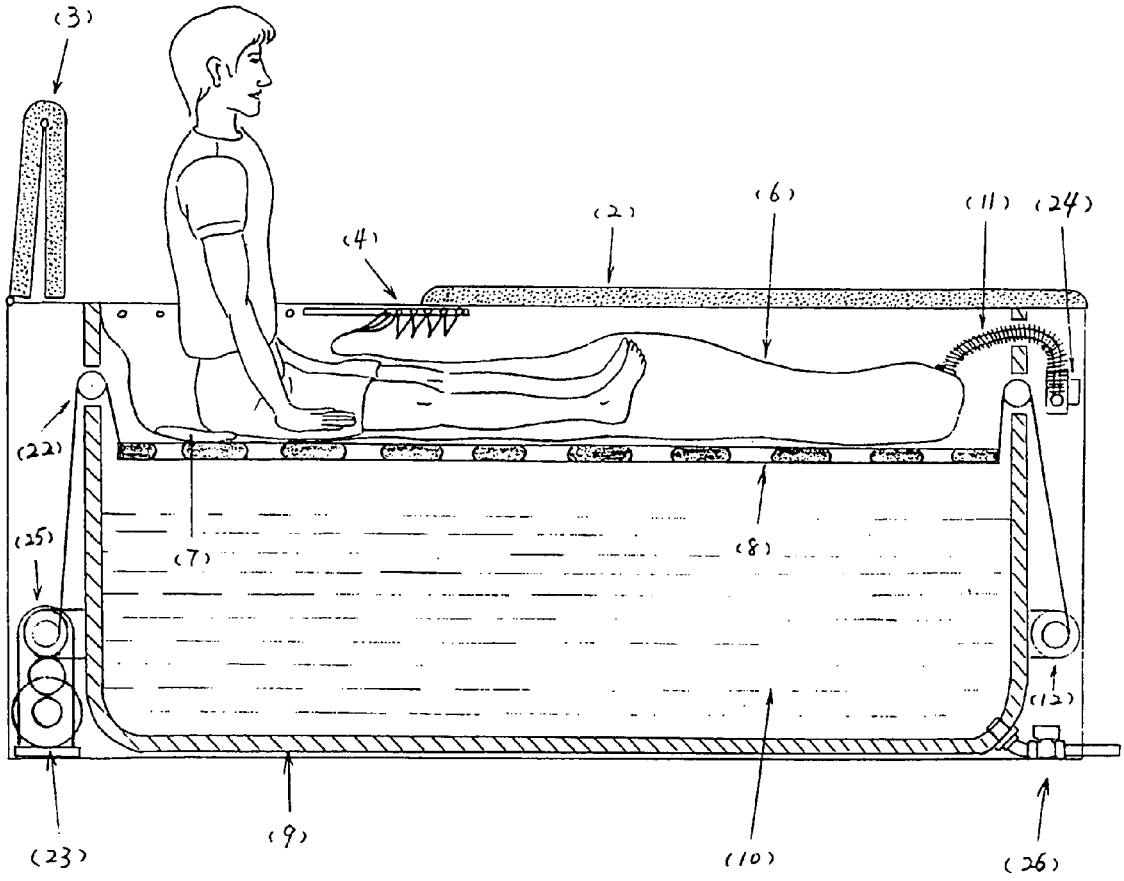
FIG. 3 is a sectional view of the floating water bed with a sitting user according to the above first preferred embodiment of this invention.
Figure 4:
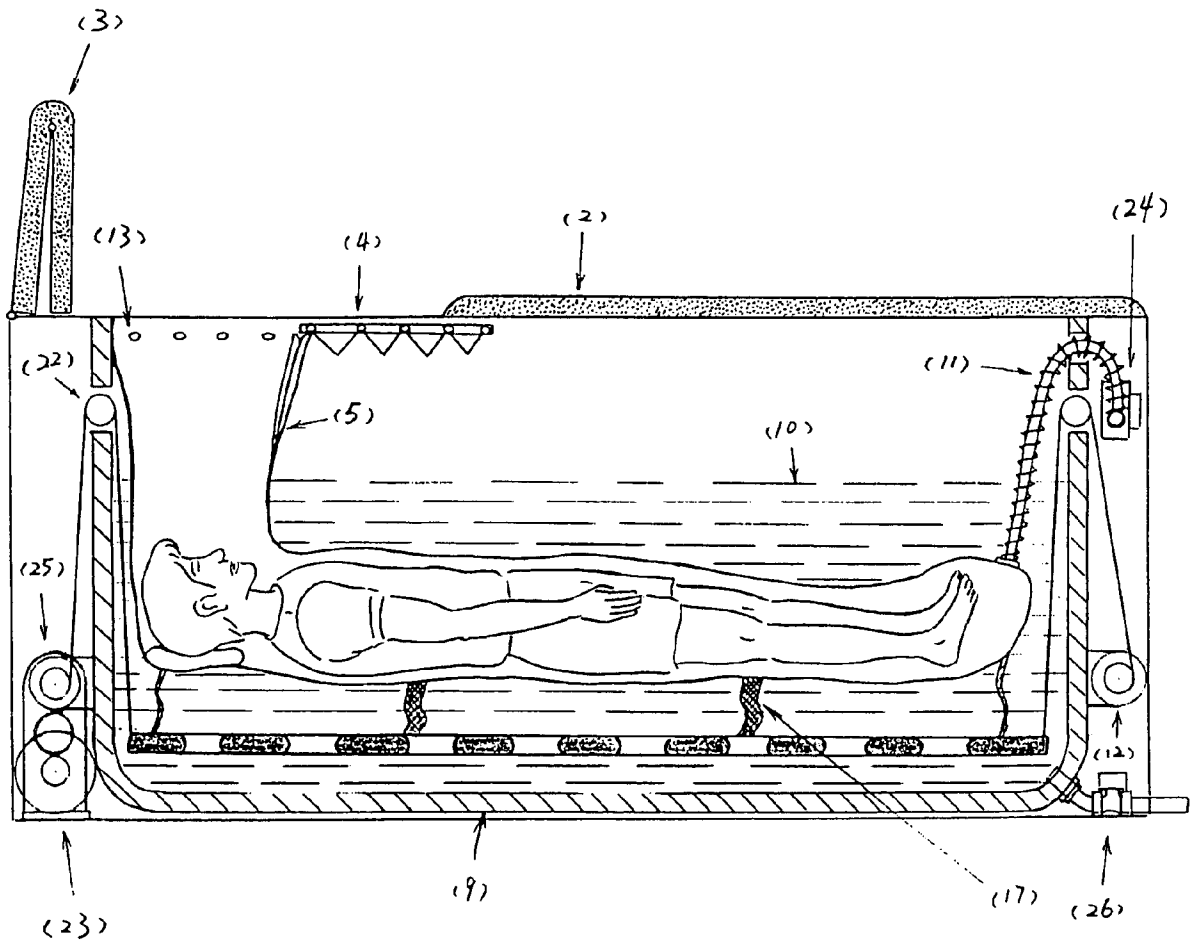
FIG. 4 is a sectional view of the floating water bed with a lying user according to the above first preferred embodiment of this invention.
Figure 5:
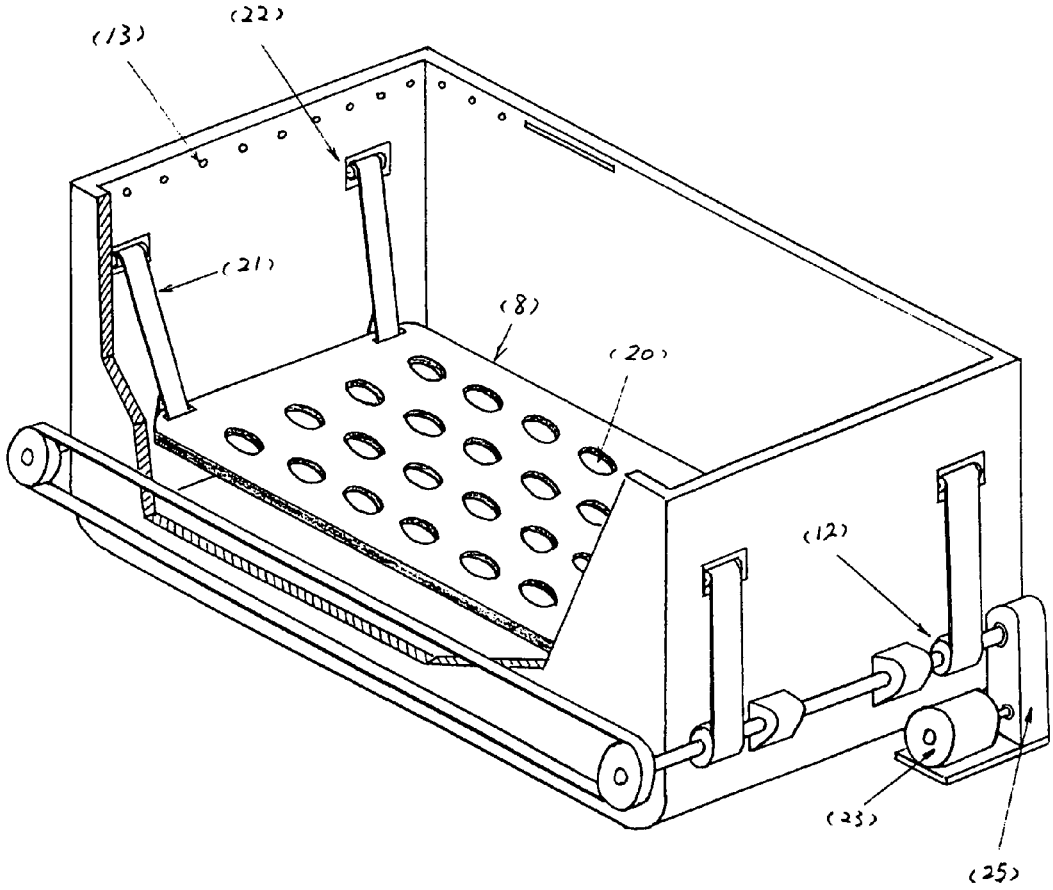
FIG. 5 is a sectional perspective view of the water tub of the floating water bed according to the above first preferred embodiment of this invention.

Please see drawings FIG. 3, FIG. 4 and FIG. 5 for the following description:

Number (9) illustrates a big water tub and it is located within the surrounding walls (1). It is made from strong plastic material and the size of the tub is approximately 90 inches in length, 50 inches in width, and 35 inches in height (90"×50"×35"). The thickness of the tub (9) cannot be less than 0.5 inches to assure ample supporting strength. (The actual size of the tub should be determined according to need and determined after conducting many tests of durability and stability). The tub (9) will also have an outlet for water to enter and another one for water to exit the tub (9). In addition, the tub (9) will have tubes connected to it made from the same material as the tub (9) itself. Because these aspects of the Floating Water Bed are not the main points of this invention, no further detail will be listed.

The sleeping bag (6) is the main point of this invention, it is a unique and innovative sleeping bag and it is consisted of four parts. The first part, as shown in the drawing, is the opening (5) of the sleeping bag. This is the most crucial part of the sleeping bag design. Because consumers will vary in length, size and weight, the opening (5) of the sleeping bag (6) must be easy to expand or contract to allow everyone easy access into the sleeping bag (6). Therefore, the front and sides of this opening (5) is designed to be fan-like structures. Number (4) illustrates the four fan-like structures at the front of the sleeping bag (6). Number (13) illustrates pins securing the sleeping bag (6) to the walls (1) of the water tub (9). Number (4) illustrates the fan-like structures at the side of the water tub (9). These structures (4) are folded against the sides of the tub (9), the opening (5) of the sleeping bag (6) as expanded to its maximum width. When these fan-like structures (4) are pulled towards each other, the width of the sleeping bag opening (5) is being contracted to its minimum. It is taking into consideration that when consumers are sleeping within the sleeping bag (6), some may choose to sleep on their backs while others choose to sleep on their sides. To allow for easy breathing no matter which position consumers choose to sleep in, a well-shaped hole perpendicular to the sleeping bag (6) was created to be an opening (5) in the drawing. The fan-like structure (4) at the front of the sleeping bag opening (5) is secured to the surface of the bed; the other three sides of the sleeping bag (6) are secured to the top of the surrounding walls (1) of the water tub (9). This is to prevent the sleeping bag (6) from moving away from the walls (1) of the tub (9). The opening (5) of the sleeping bag (6) extends from the surface (2) (3) of the Floating Water Bed all the way to the bottom of the sleeping bag (6). The length of the opening (5) is long enough for the sleeping bag (6) to be lowered into the water without any obstacles. When an individual is floating mid-water, the opening (5) of the sleeping bag (6) is positioned to be directly above the head of the individual within the sleeping bag (6). This will ensure that the individual can breathe easily and normally. On the top of the two sides of the water tub (9), there are two creases, one on each side of the tub (9) along the top. On the front of the sleeping bag (6), at each folded section of the fan-like structure (4), there is a piece of wire extending through that section. The two ends of these wires are placed within the creases along the top of the tub wall (1) so as then fan-like structure (4) is being moved, those wires can move freely along the crease. In addition, it secures the fan-like structure (4) along the top of the tub walls (1) so that even though the sleeping bag (6) itself is soft, the structure (4) will not fall and collapse. The length of the creases along the top of the tub wall (1) also determines the size of the opening (5) of the sleeping bag (6).

Figure 6:
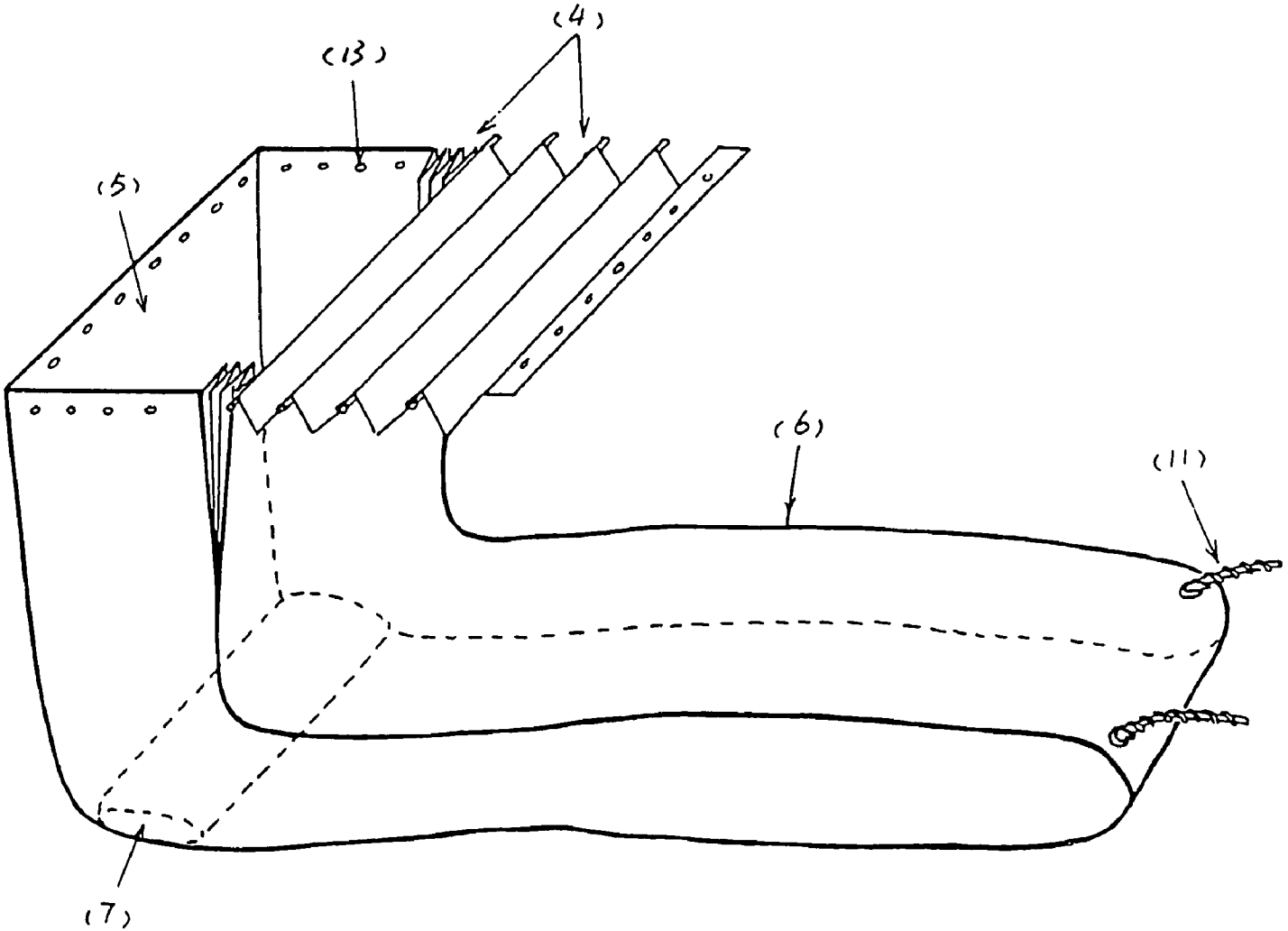
FIG. 6 is a perspective view of the sleeping bag of the floating water bed according to the above first preferred embodiment of this invention.

The body of the sleeping bag, labeled number (6) in the drawing, has the approximate length of 75 inches, width 40 inches and thickness of 15 inches (75"×40"×15"). It ensures that individuals within the sleeping bag (6) will have ample room to turn and move his limbs. In addition, the sleeping bag (6) is designed to the soft and thin. The thickness of the sleeping bag (6) cannot exceed 4 mm. The sleeping bag (6) consist of three layers all sticking together, refer to FIG. 6 for the following descriptions:

The outer most layer is a waterproof layer labeled number (18) in the drawing. It must be soft, resilient and stretchable and it is made from latex rubber. The middle layer is an electric protection layer numbered (17) in the drawing. It must be a thin layer of plastic, no thicker than 0.5 mm. On the side closer to the waterproof layer, there are numerous circuit traces printed on the plastic using a mixture of the copper power and special glue. These circuit traces are either positive or negative and they are arranged closely together in an interchangeable parallel pattern of positive and negative then negative and positive. The width of these circuit traces are uniformly designed to be 2 mm. The space between each pair of positive and negative circuit traces are uniformly designed to be 1 mm, refer to number (19) on the drawing for a visual of these circuit traces. In a normal situation, positive and negative circuits do not pass through to each other. However, when the sleeping bag (6) begins to deteriorate after long time of use and water begins to seep into the layers (17) (18) of the sleeping bag (6), the positive negative circuits within this middle layer (17) will automatically pass electricity to each other. Even the smallest drop of water will cause this reaction to begin. These circuit (19) traces will immediately notify the protection circuit board to lift the sleeping bag (6) out of the water and raise the sleeping bag (6) to the top to ensure the safety of the individual inside. (In order to aide the middle protection layer, ample amounts of salt must be present in the water within the water tub (9) to increase the water's ability to conduct electricity. This large amount of salt and water should be 50:1.) Because the protection circuit is not a main aspect of this invention and because such circuit boards already exist, no further detail will be described about such circuit boards.

The third or inner most layer, labeled number (16) in the drawing, can be made by using either corduroy or flannel material. The purpose of the inner most layer (16) is make the inside of the sleeping bag (6) feel soft to the touch and thus providing comfort for the individual inside. Lastly, these three layers (18) (17) (16) are stuck together to create one layer of the sleeping bag bedding.

The third aspect of the sleeping bag (6) is the air filled pillow labeled number (7) in the drawing. The design of this pillow (7) is relatively simple. This pillow (7) is designed to have the same width as the sleeping bag (6) it lies within. It is placed at the bottom layer of the sleeping bag (6) and is meant for the individual to rest his head upon. Its purpose is to prevent the sleeping bag (6) from sticking to and wrapping around the individual's head due to the pressure from the surrounding water and disabling normal breathing. In addition it lifts the individual's head slightly above the individual's feet so blood flow will not concentrate in the head causing unnecessary discomfort and health complication. The amount of air within this pillow (7) can be determined according to consumer need. The fourth and last aspect of the sleeping is the air flow process via the air tubes at the foot of the sleeping bag numbered (11) in the drawing. At the foot of the sleeping bag (6) there are two air tubes (11), these tubes (11) must also be made from latex rubber material to produce spiral air tubes (11). These spiral rubber tubes (11) must also have resilience, durability and flexibility. When the sleeping bag (6) is being lifted or lowered into the water, these tubes (11) must have the flexibility to expand and contract to compliment the movement of the sleeping bag (6). The other end of these rubber air tubes (11) are connected to a small air pump. Through this pump, fresh air can periodically but slowly enter the sleeping bag (6) and air can be easily distributed throughout the inside of the sleeping bag (6). The temperature of this ingoing air can be adjusted and controlled. The purpose of this is to prevent the individual from feeling stuffy within the sleeping bag (6) while preventing the sleeping bag (6) from wrapping around the individual due to pressure from the surrounding water, disabling the individual from freely moving. The air enters from the rubber air tubes (11), flows through the sleeping bag (6) and exits via the well-shaped opening. This ensures that the individual will constantly receive fresh, circulating air.

Figure 7:
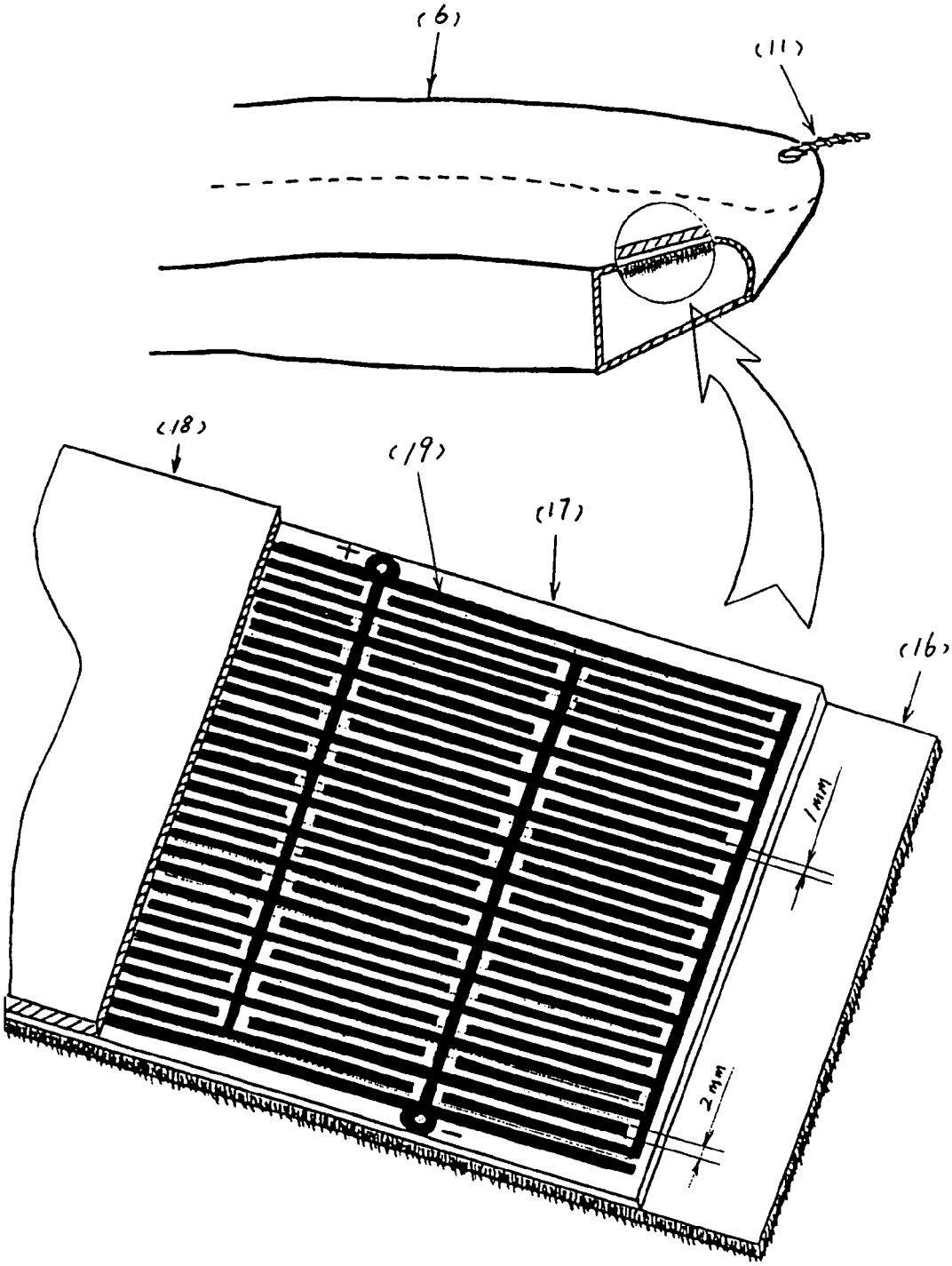
FIG. 7 is a partially sectional enlarged view of the sleeping bag of the floating water bed according to the above first preferred embodiment of this invention.

The other special quality of this Floating Water bed is the movable mattress pad. The structures of this movable mattress pad are clearly depicted in FIG. 3, FIG. 4 and FIG. 7. From these drawings label number (8) clearly depicts a big mattress pad. It is a relatively flat area on which the sleeping bag (6) can be laid. The size of this movable mattress pad are approximately 75 inches in length, 40 inches in width, and 2 inches in thickness (75"×40"×2"). This mattress pad (8) should be made from strong and durable plastic or nylon to ensure that it can adequately support the weight of any person. On the mattress pad (8) are many specially designed holes labeled number (20) in the drawings. The diameters of these holes (20) are approximately Φ2 inches. The purpose of these holes (20) is to allow water to easily pass through and reduce the resistance between the pad (8) and the water as the pad (8) is being moved up and down. At the each end of the mattress pad (8) there are two rectangular shaped holes each 2 inches in length and 1 inch in width (2"×1"). These rectangular holes are designed so that rotating belts could be looped through these holes; these rotating belts are numbered (21) in the drawings. As one end of these rotating belts (21) are attached to the rectangular holes on the ends of the mattress pad (8), the other end is attached so rotating wheels at the top ends of the water tub (9). These rotating wheels are numbered (12) in the drawings. As the rotating wheels (12) rotate to contract the belts (21), the mattress pad (8) will then be slowly moved out of the water and lifted towards the surface of the bed. The individual along with the sleeping bag (6) will also leave the water via the mattress pad and the lifted towards the top of the bed. When the rotating wheels (12) rotate to expand the belts (21), it will slowly lower the mattress pad (8) back into the water. The sleeping bag (6) will also reenter the water along with the mattress pad (8). Rotating belts (21) should be made from thin strings of nylon netted together to produce these thick and sturdy belts. By netting together fine strings of nylon, it can ensure that the belt will have adequate strength and durability to accept the full weight of any individual. In addition, these belts will not deteriorate due to long period of time soaking in water. The purpose of the movable mattress pad (8) is, when the mattress pad (8) is above the water at the top of the bed a human being will have easy access in and out of the sleeping bag (6). When the mattress pad (8) is being the water, it will bring the sleeping bag (6) and the individual inside slowly down into the water as well until the individual is floating in mid-water. In case there is a leak in the sleeping bag (6), the protection circuit board will automatically rotate the rotation wheels (12) and lift the mattress pad (8) out of the power and raise it to the surface, thereby bringing the sleeping bag (6) and the individual out of the water as well. This will ensure the absolute safety of the individual inside the sleeping bag (6). In addition, at the head, body and feet of the sleeping bag (6) there exists eight places in which netted nylon belts are looped to secure the sleeping bag (6) to the movable mattress pad (8). These eight nylon belts are numbered (14) in the drawings. The length of these netted nylon belts (14) should be approximately 5 inches, this allows the sleeping bag (6) to float freely on its own without it rotating in uncomfortable positions bringing unnecessary discomfort or anxiety to the individual inside.

Lastly, in the bottom of the Floating Water Bed's water tub, there exist many electro-thermal wires or heat emitting light bulbs. The purpose of these wires or bulbs is to control the temperature of the water all year round to ensure a comfortable environment for the individual inside to receive abundant amounts of rest and relaxation.

Regarding the specific details of the temperature control system, protection circuit board, rotation system, and all other electric controls of the Floating Water Bed can be varied because there already exists many systems and designs that can adequately serve these purpose. Therefore, the details of these systems are not listed within this patent document and are not considered a crucial part of this new design. There will be not further details regarding these systems listed.

Figure 8:
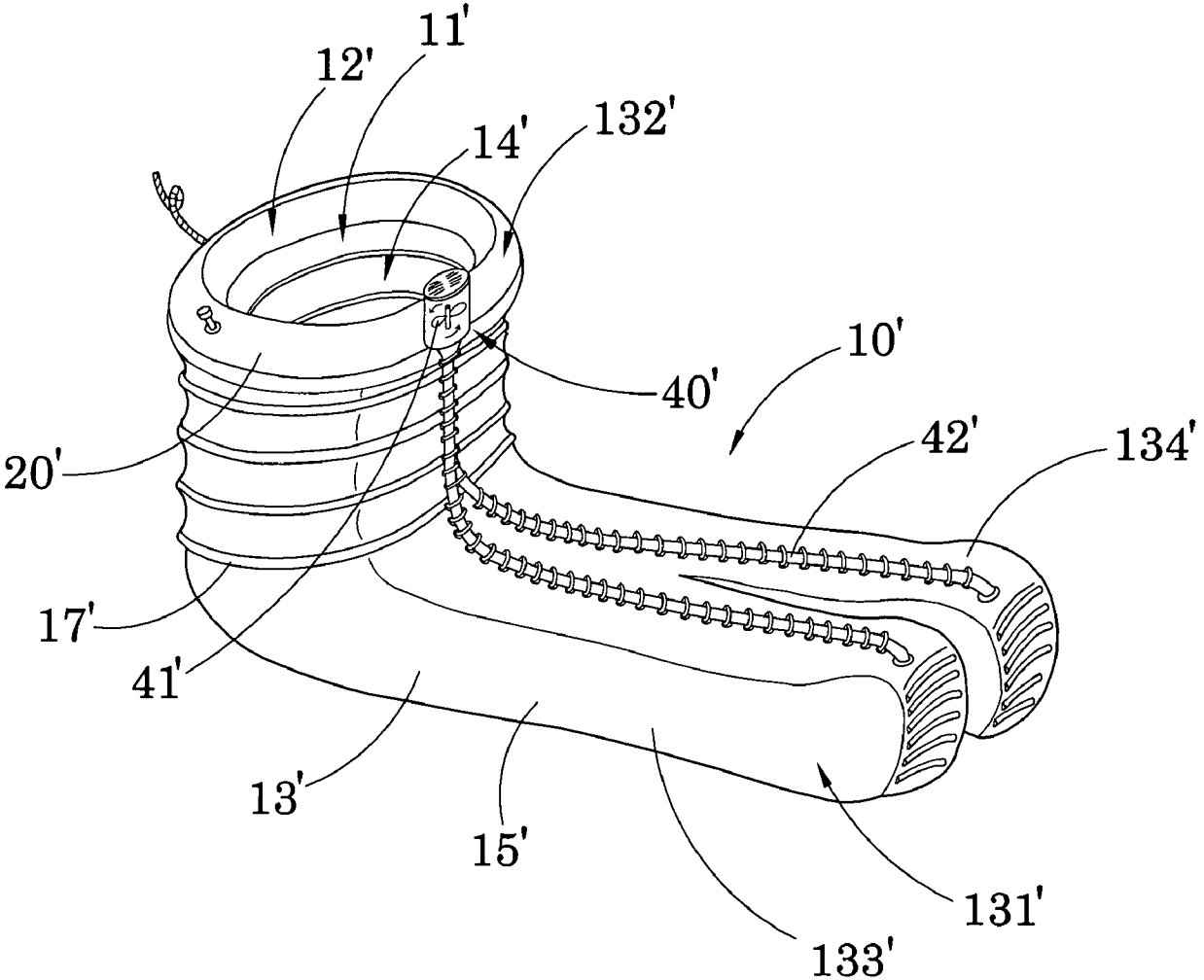
FIG. 8 is a perspective view of a floating water bed according to a second preferred embodiment of the present invention.
Figure 9:
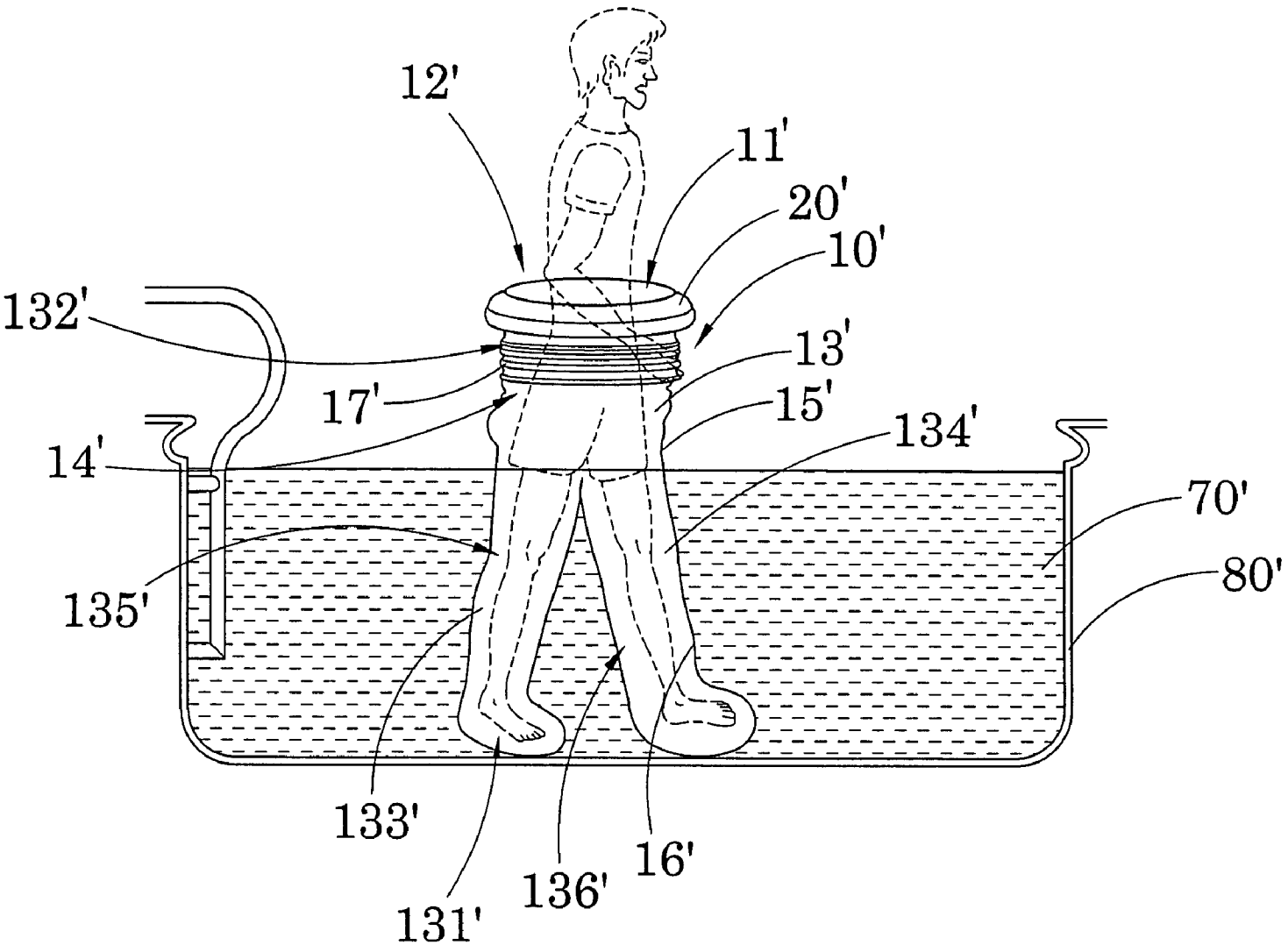
FIG. 9 is a schematic diagram of the floating water bed according to the above second preferred embodiment of the present invention.
Figure 10:
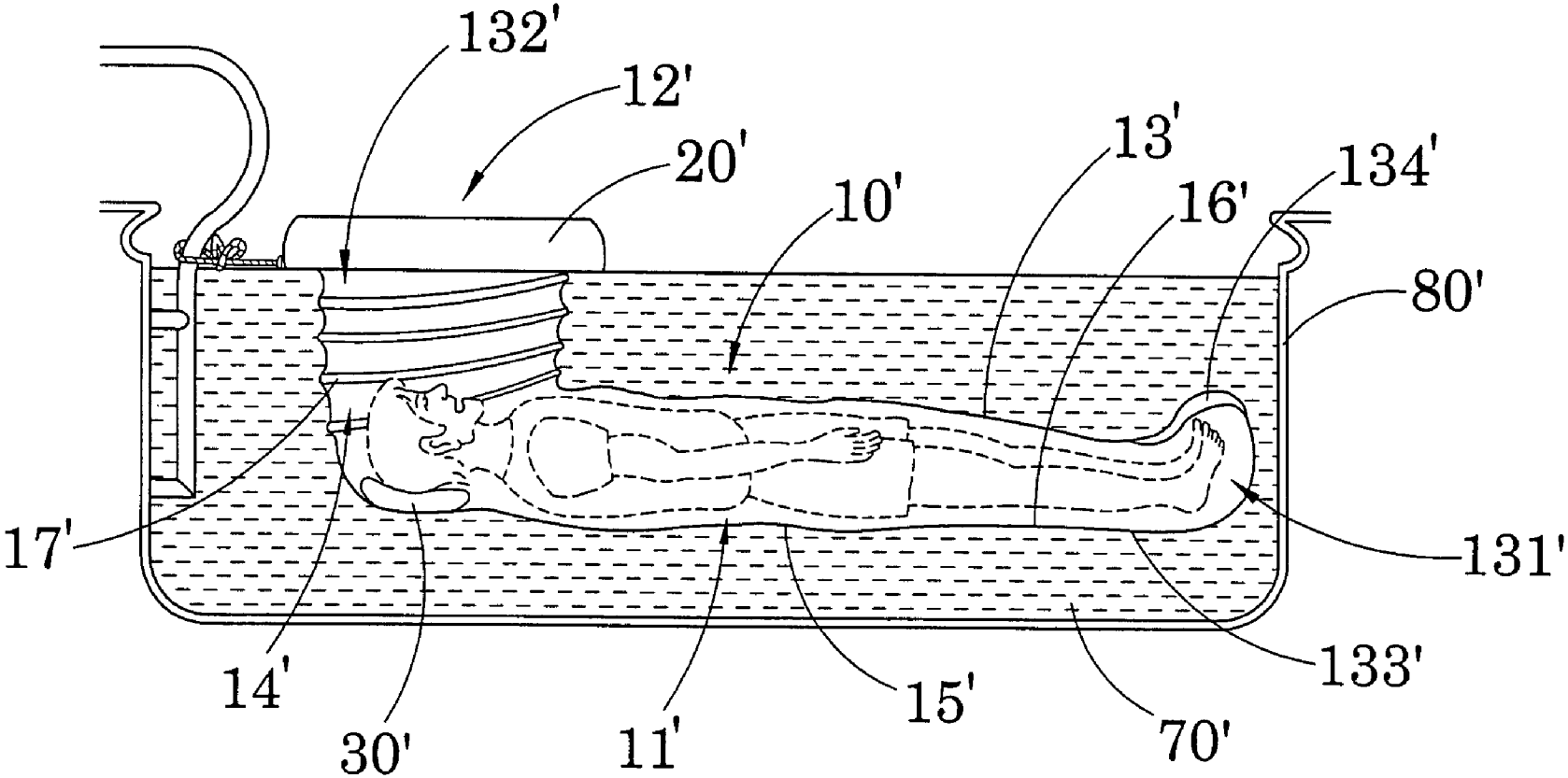
FIG. 10 is a sectional side view of the floating water bed according to the above second preferred embodiment of the present invention.

Referring to FIG. 8 to FIG. 10 of the drawings, a floating water bed according to a second preferred embodiment of the present invention is illustrated, in which the floating water bed comprises a sleeping bed 10'. The floating water bed is for a user floatably surrounded by a predetermined amount of liquid 70', such as water, contained in a predetermined liquid tank 80'.

The sleeping bag 10', which is made of waterproof material, has a compartment 11' for the user accommodating therein that the user is floating and supporting by the liquid 70', and a breathing opening 12' communicated with the compartment 11' and arranged in such a manner that when the user rests in the compartment 11', the breathing opening 12' is aligned with a head of the user, wherein the breathing opening 12' is adapted for facilitating air circulation within the compartment 11' with ambient atmosphere, such that the sleeping bag 10' is adapted for allowing the user to achieve absolute relaxation while achieving complete rest, wherein the sleeping bag 10' is adapted for completely separating the user from the liquid 70' surrounding and thus protecting the user within the sleeping bag 10'.

According to the second preferred embodiment of the present invention, the sleeping bag 10' comprises an elongated tubular body carrier 13' having a closed end 131' and an opening end 132' to define the compartment 11' therebetween for the user accommodating therein, and an elongated tubular communication tunnel 14' integrally extended from the opening end 132' of the body carrier 13' to define the breathing opening 12' at an opening of the communication tunnel 14', wherein when the body carrier 13' is lowered into the liquid 70' by the weight of the user, the communication tunnel 14' is upwardly extended from the body carrier 13' at a position that the breathing opening 12' is floated at the water level of the liquid 70' for facilitating air circulation within the compartment 11'.

It is worth mentioning that the sleeping bag 10' further comprises an outer waterproof layer 15' made from latex rubber and an inner comforting layer 16' made of flannel and overlappedly bonded to the outer waterproof layer 15', wherein the user is arranged to contact with the inner comforting layer 16' so that the user is subject to the maximum comfort imparted by the present invention. Since the outer waterproof layer 15' blocks water from entering the compartment 11' of the tubular body carrier 13', the user is able to be optimally suspended by the water surrounding the sleeping bag 10' while physically separated from the water.

As shown in FIG. 8 to FIG. 10 of the drawings, the body carrier 13' has two tubular leg receivers 133', 134' forming two leg cavities 135', 136' for receiving the legs of the user respectively so as to enhance the mobility of the user. Each of the tubular leg receivers 133', 134' is elongated in shape adapted for comfortably receiving the corresponding leg of the user so as to allow the him/her to lie down within the compartment 11'. However, when the user wishes to stand in the water, he or she is able to conveniently walk along the floor of the liquid tank 80'. In other words, the two tubular leg receivers 133', 134' are adapted to enhance the mobility of the user when he or she wishes to walk within the liquid tank 80'. Moreover, when the user wishes to stand up from a lying position lie down from a standing position, the two tubular leg receivers 133', 134' are designed to facilitate a natural leg movement of the user.

The floating water bed further comprises a ring buoy 20' affixed at the breathing opening 12' of the sleeping bag 10' for floating at the water level of the liquid 70' so as to ensure that the breathing opening 12' is to be positioned above the water level for air circulation within the compartment 11'. Thus, the ring buoy 20' is designed to ensure that the sleeping bag 10' has adequate air communication between the compartment 11' and an exterior thereof so as to ensure that the user who is lying or standing within the compartment 11' has adequate air supply. As a result, according to the preferred embodiment of the present invention, the ring buoy 20' is made of foaming material for driving the breathing opening 12' of the sleeping bag 10' to be above the water level of the liquid 70' within the liquid tank 80'. As a slight alternative, the ring buoy 20' can be made of inflatable float so that that when the inflatable float is inflated by air, the inflatable float is floating on the liquid 70'.

In order to enhance the ease with which the present invention can be utilized, the sleeping bag 10' further comprises an inflatable zigzag or spiral skeletal frame 17' affixed to a surrounding wall of the communication tunnel 14' such that the communication tunnel 14' is guided to fold via the skeletal frame 17' so as to minimize a length of the communication tunnel 14' when it is folded into a compact size. As shown in FIG. 8 of the drawings, the surrounding wall of the communication tunnel 14' is folded in a spiral manner such that the communication tunnel 14' is guided to fold to minimize a length of the communication tunnel 14' when it is folded into a compact size. In other words, the surrounding wall of the communication tunnel 14' is guided by the zigzag or spiral skeletal frame 17' for being conveniently folded into a compact size, or easily unfolded to suspendedly immerse in the liquid 70'. Moreover, when the present invention is not in use, the sleeping bag 10' can be folded to a compact size for convenient and easy storage and transportation. It is worth mentioning that the skeletal frame 17' is inflatable to support the communication tunnel 14' when it is unfolded.

In order to further enhance the inventive features of the present invention, the floating water bed further comprises an inflatable pillow 30' detachably affixed to the sleeping bag 10' within the compartment 11' and aligned with the breathing opening 12' for supporting the head of the user when the user lies and rests in the compartment 11'. The inflatable pillow 30' can be inflated by pumping air thereinto and deflated by releasing the air within the inflatable pillow 30' so that the user may, depending on the circumstances in which the present invention is utilized, freely attach and detach the inflatable pillow 30' to and from the sleeping bag 10'.

As shown in FIG. 8 of the drawings, the floating water bed further comprises an air circulation device 40' for ventilating air within the compartment 11', wherein the air circulation device 40' comprises a fan assembly 41' coupling at the breathing opening 12' of the sleeping bag 10' and an air duct 42' extended from the fan assembly 41' to the closed end 131' of the compartment 11' for air ventilation for the closed end 131' of the compartment 11'. It is important to mention that the air circulation device 40' is for enhancing air circulation within the compartment 11', especially when the user is lying into the compartment 11' and partially blocking air circulation between the breathing opening 12' and the closed end 131' of the compartment 11'. As a result, the user's legs can also be exposed to freshly circulating air within the compartment 11' when he or she is floating within the liquid 70'.

Figure 11:
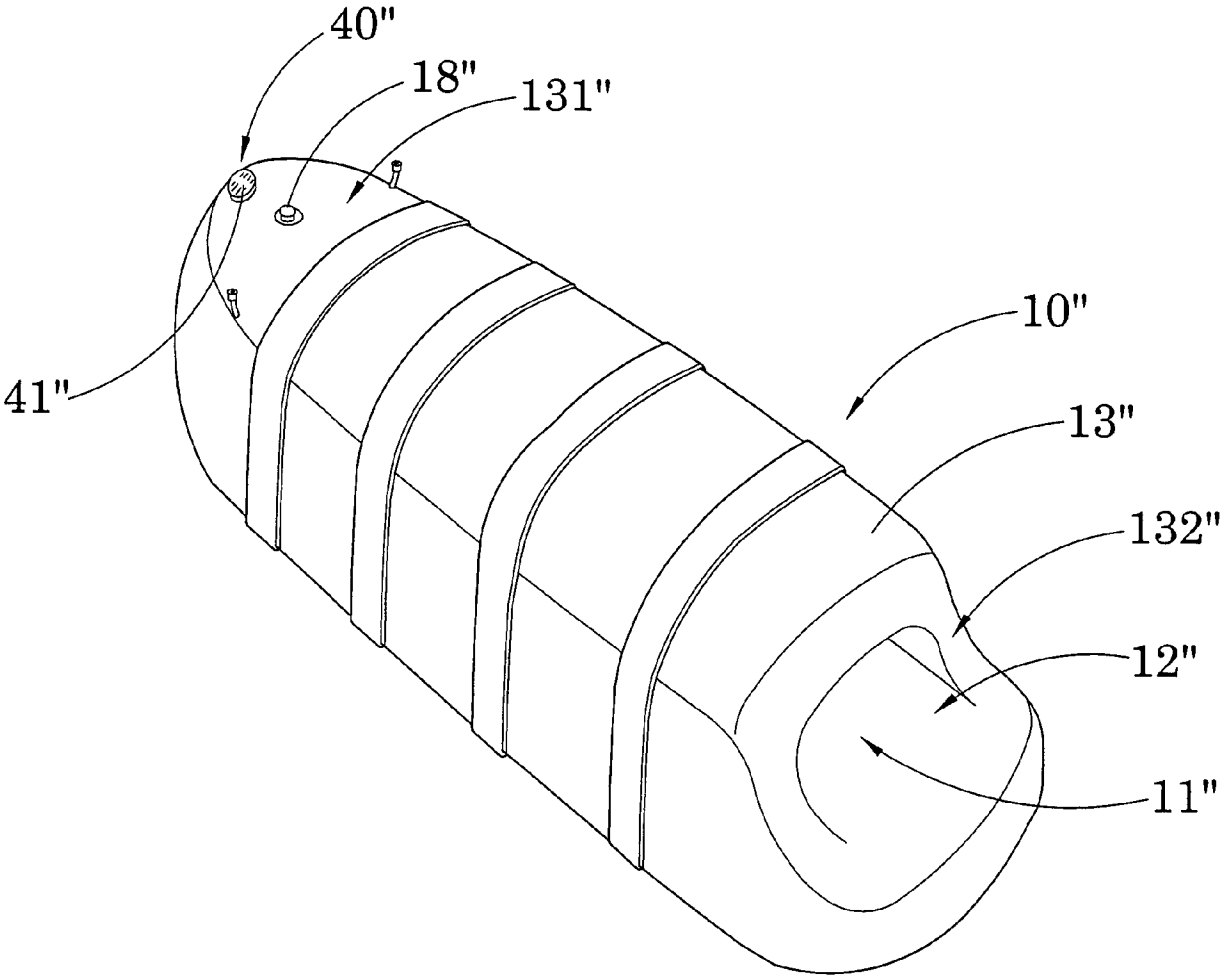
FIG. 11 is an alternative mode of the floating water bed according to the above second preferred embodiment of the present invention.
Figure 12:
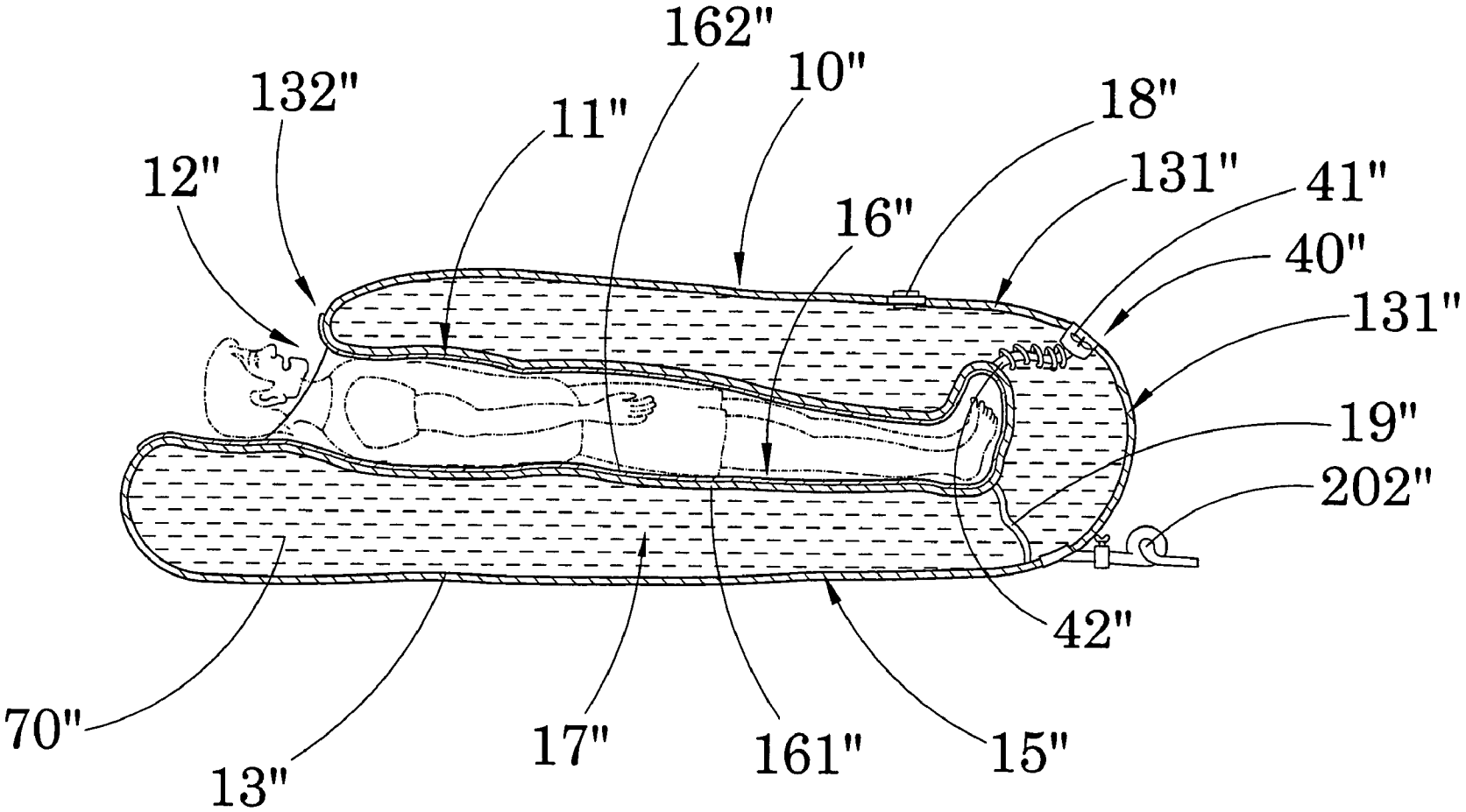
FIG. 12 is a perspective view of the alternative mode of the floating water bed according to the above second preferred embodiment of the present invention.
Figure 13:
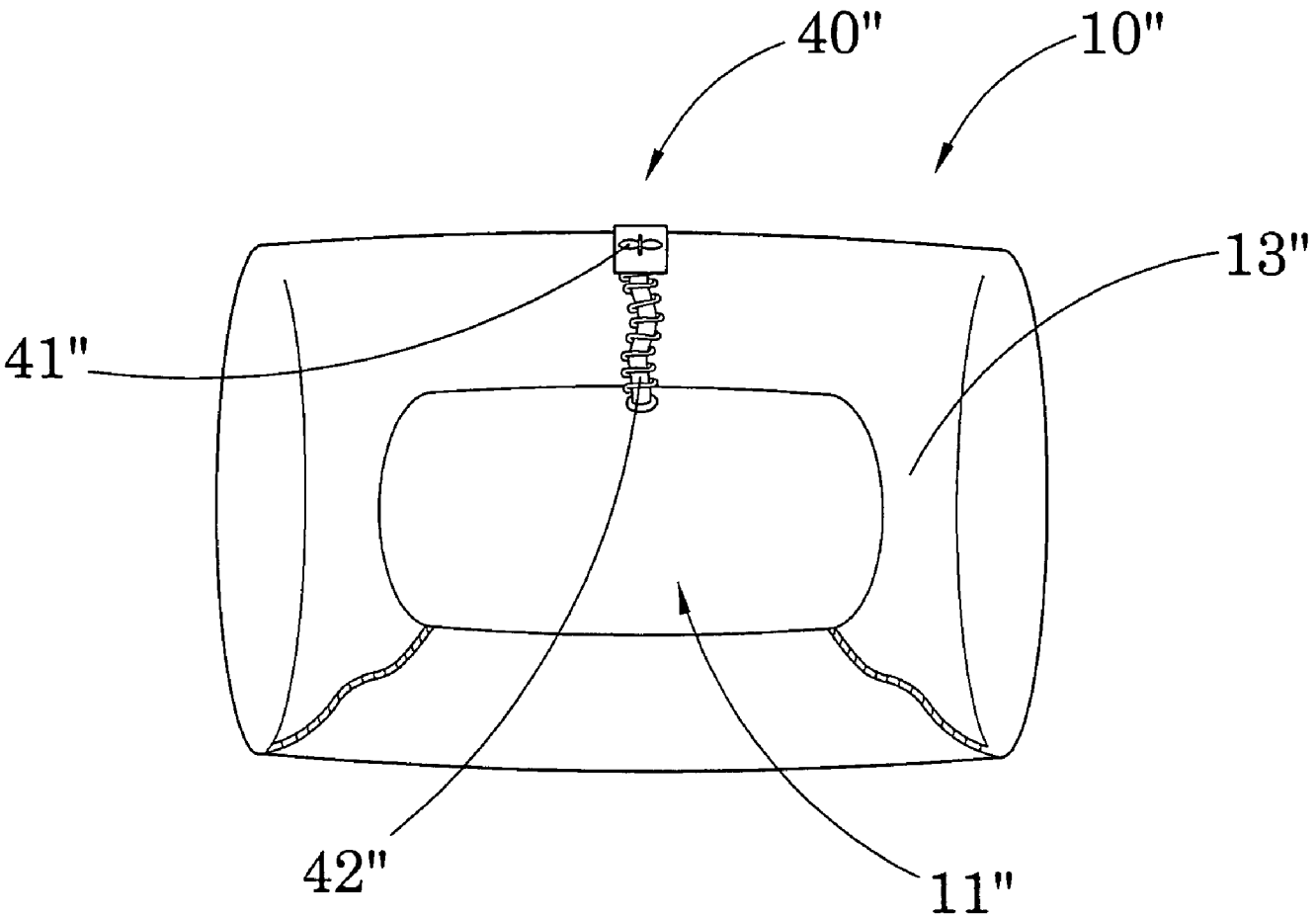
FIG. 13 is a front view of the alternative mode of the floating water bed according to the above second preferred embodiment of the present invention.

Referring to FIG. 11 to FIG. 13 of the drawings, an alternative mode of the floating water bed according to the above second preferred embodiment of the present invention is illustrated. This alternative mode is similar to the second preferred embodiment except that the sleeping bag 10" comprises an elongated tubular body carrier 13" having a closed end 131" and an opening end 132" to define the compartment 11" therebetween for the user accommodating therein, wherein the sleeping bag 10" is constructed with an outermost layer 15", an innermost layer 16" overlapping thereat to define a liquid chamber 17" between the outermost 15" and the innermost layer 16", and a liquid outlet 18" provided at the outermost layer 15" for filling the liquid 70" into the liquid chamber 17" such that when the sleeping bag 10" is filled with the liquid 70", the user is floated and surrounded by the liquid 70" within the tubular body carrier 13".

Moreover, the sleeping bag 10" further comprises at least a retention strip 19" having two ends coupling between the outermost and innermost layers 15", 16" at the closed end 131" of the body carrier 13" for retaining a distance between the outermost and innermost layers 15", 16" via a length of the retention strip 19" when the sleeping bag 10" is filled with the liquid 70". In other words, the user is able to lie down in the compartment 11" while the user is not required to fully fill the liquid tank 80' with the liquid 70". Thus, liquid 70" consumption of the liquid 70" can be minimized.

Moreover, the floating water bed further comprising an air circulation device 40" for ventilating air within the compartment 11", wherein the air circulation device 40" comprises a fan assembly 41" coupling at the outermost layer 15" of the sleeping bag 10" and an air duct 42" extended from the fan assembly 41" to the innermost layer 16" of the sleeping bag 10" at the closed end 311" of the compartment 11" for air ventilation. As in the second preferred embodiment, the air circulation device 40" is to enhance air circulation within the compartment 11" especially when the user is lying into the compartment 11" and partially blocking air circulation between the breathing opening 12" and the closed end 131" of the compartment 11". As a result, the user's legs can also be exposed to freshly circulating air within the compartment when he or she is floating within the liquid 70".

In order to enhance the comfort of the user lying within the compartment 11", the innermost layer 16" comprises a waterproof layer 161" formed on an outer side of the innermost layer 16" to contact with the liquid 70", and a cloth layer 162" formed on an inner side of the innermost layer 16" to contact with the compartment 11" so that the user lying therein would be in contact with the cloth layer 162".

Figure 14:
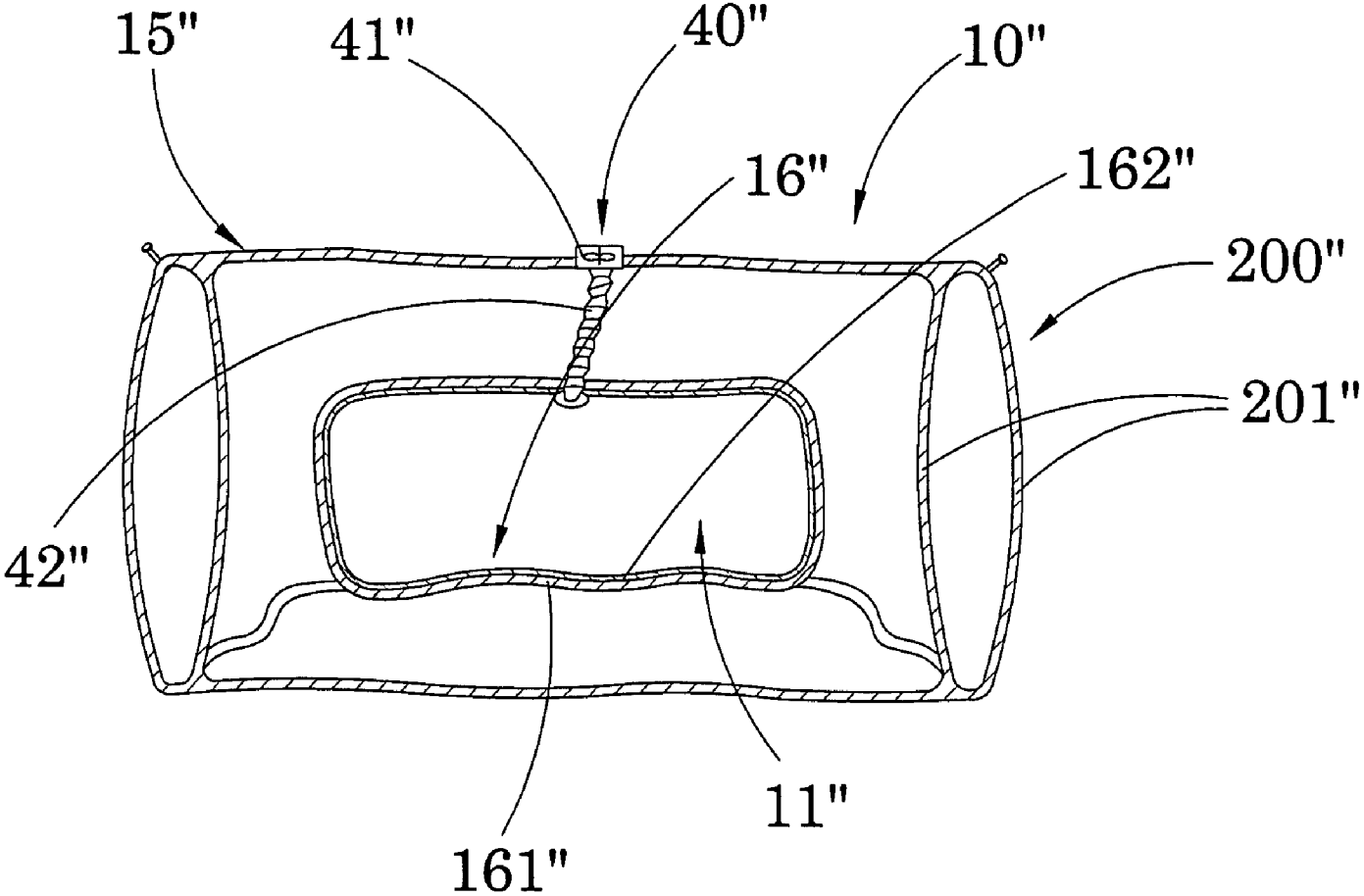
FIG. 14 is a sectional front view of the alternative mode of the floating water bed according to the above second preferred embodiment of the present invention.
Figure 15:
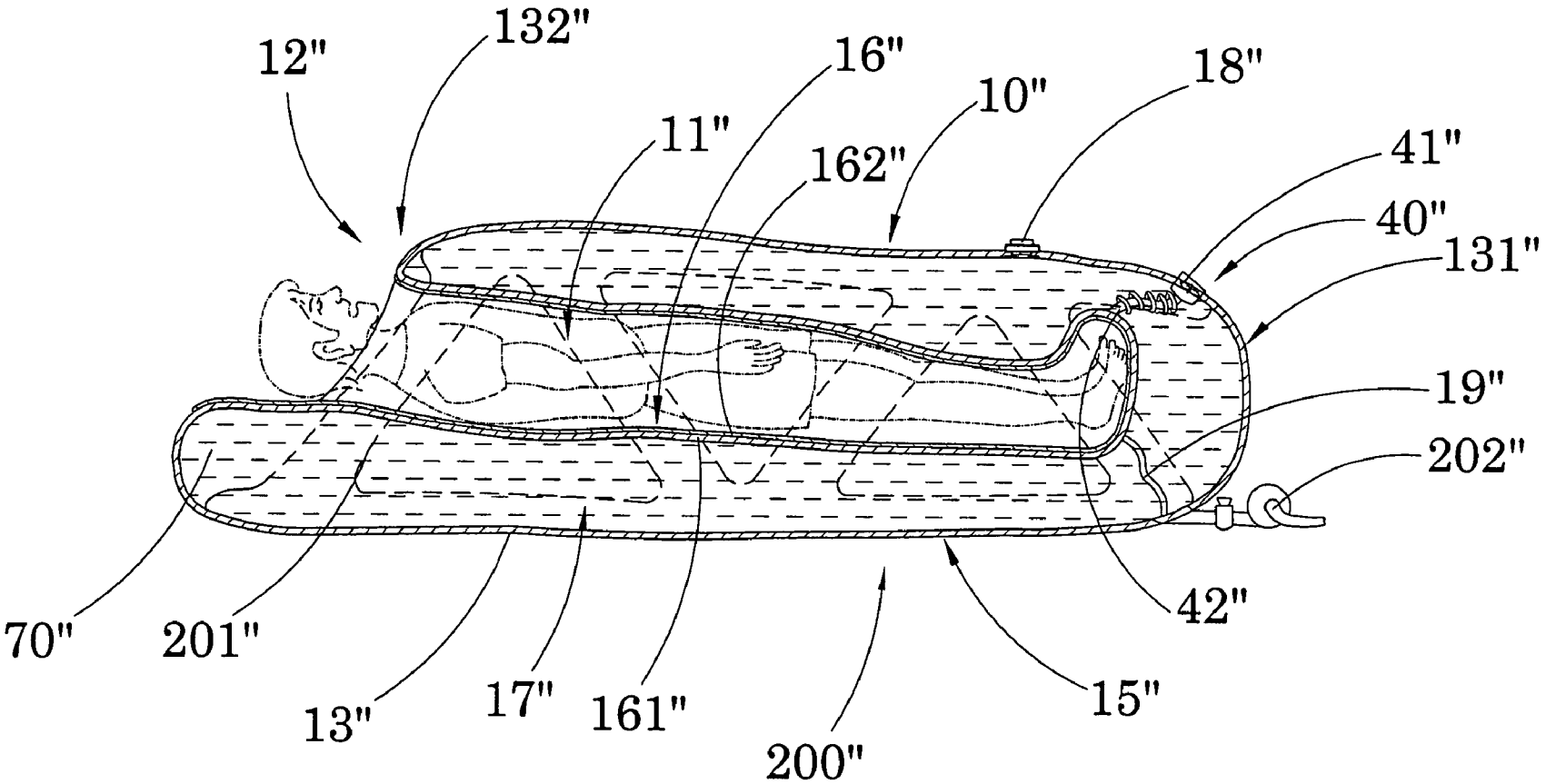
FIG. 15 is a sectional side view of the alternative mode of the floating water bed according to the above second preferred embodiment of the present invention.

Referring to FIG. 14 to FIG. 15 of the drawings, the sleeping bag 10" further comprises an inflatable reinforcing frame 200" provided at two sides of the sleeping bag 10" to prevent the sleeping bag 10" from collapsing when the inflatable reinforcing frame 200" is fully inflated. More specifically, the inflatable reinforcing frame 200" comprises a plurality of inflatable frame members 201" inclinedly provided within the sleeping bag 10" to form a corresponding number of triangular structures by each two inflatable frame members 201" wherein the inflatable frame members 201" are adapted to be inflated with air for upholding a structural strength of the sleeping bag 10". Accordingly, the sleeping bag 10" further comprises an inflating inlet 202" provided on the sleeping bag 10" to communicate the inflatable reinforcing frame 200" with an exterior of the sleeping bag 10". Thus, a user of the present invention is able to inflate or deflate the inflatable reinforcing frame 200" via the inflating inlet 202". It is worth mentioning that each of the inflatable frame members 201", having a tubular structure, is made of the same waterproof materials as that of the sleeping bag 10" so that when the sleeping bag 10" and the inflatable reinforcing frame 200" are deflated, the entire sleeping bag 10" along with the inflatable reinforcing frame 200" can be folded into a compact size for easy carrying and storage.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A floating water bed for a user being floatably surrounded with liquid, comprising a sleeping bag, which is made of waterproof material, having a compartment for said user accommodating therein that said user is floating and supporting by said liquid, and a breathing opening communicating with said compartment and arranged in such a manner that when said user rests in said compartment, said breathing opening is aligned with a head of said user, wherein said breathing opening is adapted for air circulation of said compartment with ambient atmosphere, such that said sleeping bag is adapted for allowing said user to achieve absolute relaxation while achieving complete rest, wherein said sleeping bag is adapted for completely separating said user from said liquid surrounding and thus protecting said user within said sleeping bag, and comprises an elongated tubular body carrier having a closed end and an opening end to define said compartment therebetween for said user accommodating therein, and an elongated tubular communication tunnel integrally extended from said opening end of said body carrier to define said breathing opening at an opening of said communication tunnel, wherein when said body carrier is lowered into said liquid by a weight of said user, said communication tunnel is upwardly extended from said body carrier at a position that said breathing opening is floated at a liquid level of said liquid for air circulation.

2. The floating water bed, as recited in claim 1, wherein said sleeping bag comprises an outer waterproof layer made from latex rubber and an inner comforting layer made of flannel and overlappedly bonded to said outer waterproof layer.

3. The floating water bed, as recited in claim 1, wherein body carrier has two tubular leg receivers forming two leg cavities for receiving legs of said user respectively so as to enhance the mobility of said user.

4. The floating water bed, as recited in claim 2, wherein body carrier has two tubular leg receivers forming two leg cavities for receiving legs of said user respectively so as to enhance the mobility of said user.

5. The floating water bed, as recited in claim 1, further comprising a ring buoy affixing at said breathing opening of said sleeping bag for floating at said liquid level of said liquid so as to ensure said breathing opening being positioned above said liquid level for air circulation.

6. The floating water bed, as recited in claim 4, further comprising a ring buoy affixing at said breathing opening of said sleeping bag for floating at said liquid level of said liquid so as to ensure said breathing opening being positioned above said liquid level for air circulation.

7. The floating water bed, as recited in claim 6, wherein said ring buoy is made of foaming material for floating on said liquid.

8. The floating water bed, as recited in claim 6, wherein said ring buoy is made of inflatable float that when said inflatable float is inflated by air, said inflatable float is floating on said liquid.

9. The floating water bed, as recited in claim 1, wherein said sleeping bag further comprises a spiral skeletal frame affixed to a surrounding wall of said communication tunnel such that said communication tunnel is guided to fold via said skeletal frame to minimize a length of said communication tunnel.

10. The floating water bed, as recited in claim 6, wherein said sleeping bag further comprises a spiral skeletal frame affixed to a surrounding wall of said communication tunnel such that said communication tunnel is guided to fold via said skeletal frame to minimize a length of said communication tunnel.

11. The floating water bed, as recited in claim 1, wherein a surrounding wall of said communication tunnel is folded in a zigzag manner such that said communication tunnel is guided to fold to minimize a length of said communication tunnel.

12. The floating water bed, as recited in claim 6, wherein a surrounding wall of said communication tunnel is folded in a zigzag manner such that said communication tunnel is guided to fold to minimize a length of said communication tunnel.

13. The floating water bed, as recited in claim 10, further comprising an inflatable pillow affixing to said sleeping bag within said compartment and aligning with said breathing opening for supporting said head of said user when said user rests in said compartment.

14. The floating water bed, as recited in claim 12, further comprising an inflatable pillow affixing to said sleeping bag within said compartment and aligning with said breathing opening for supporting said head of said user when said user rests in said compartment.

15. The floating water bed, as recited in claim 13, further comprising an air circulation device for ventilating air within said compartment, wherein said air circulation device comprises a fan assembly coupling at said breathing opening of said sleeping bag and an air duct extended from said fan assembly to said closed end of said compartment for air ventilation.

16. The floating water bed, as recited in claim 14, further comprising an air circulation device for ventilating air within said compartment, wherein said air circulation device comprises a fan assembly coupling at said breathing opening of said sleeping bag and an air duct extended from said fan assembly to said closed end of said compartment for air ventilation.

17. The floating water bed, as recited in claim 1, wherein said sleeping bag comprises an elongated tubular body carrier having a closed end and an opening end to define said compartment therebetween for said user accommodating therein, wherein said sleeping bag is constructed with an outermost layer, an innermost layer overlapping thereat to define a liquid chamber between said outermost and innermost layers, and a liquid outlet provided at said outermost layer for filling said liquid into said liquid chamber such that when said sleeping bag is filled with said liquid, said user is floated and surrounded with said liquid.

18. The floating water bed, as recited in claim 15, wherein said sleeping bag further comprises at least a retention strip having two ends coupling between said outermost and innermost layers at said closed end of said body carrier for retaining a distance between said outermost and innermost layers via a length of said retention strip when said sleeping bag is filled with said liquid.

19. The floating water bed, as recited in claim 18, further comprising an air circulation device for ventilating air within said compartment, wherein said air circulation device comprises a fan assembly coupling at said outermost layer of said sleeping bag and an air duct extended from said fan assembly to said innermost layer of said sleeping bag at said closed end of said compartment for air ventilation.

20. The floating water bed, as recited in claim 19, wherein said sleeping bag further comprises an inflatable reinforcing frame provided at two sides of said sleeping bag to prevent said sleeping bag from collapsing, wherein said inflatable reinforcing frame comprises a plurality of inflatable frame members spacedly provided within said sleeping bag to form a corresponding number of triangular structures by each three inflatable frame members wherein said inflatable frame members are adapted to be inflated with air for upholding a structural strength of said sleeping bag.

* * * * *